US009228157B2

(12) United States Patent
Chambers et al.

(10) Patent No.: US 9,228,157 B2
(45) Date of Patent: Jan. 5, 2016

(54) MANUFACTURE OF HIGH ACTIVE DETERGENT PARTICLES

(75) Inventors: John George Chambers, Bromborough (GB); Stephen Thomas Keningley, Wirral (GB); Steven James Kynaston, Wirral (GB); Jonathan Osler, Wirral (GB); William John Wilson, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 945 days.

(21) Appl. No.: 13/264,772

(22) PCT Filed: Apr. 21, 2010

(86) PCT No.: PCT/EP2010/055256

§ 371 (c)(1),
(2), (4) Date: Nov. 14, 2011

(87) PCT Pub. No.: WO2010/122050

PCT Pub. Date: Oct. 28, 2010

(65) Prior Publication Data

US 2012/0058266 A1 Mar. 8, 2012

(30) Foreign Application Priority Data

Apr. 24, 2009 (EP) ..... 09158718

(51) Int. Cl.

| | |
|---|---|
| ***C11D 11/00*** | (2006.01) |
| ***C11D 17/06*** | (2006.01) |
| ***C11D 1/22*** | (2006.01) |
| ***C11D 1/83*** | (2006.01) |
| ***C11D 1/86*** | (2006.01) |
| ***C11D 1/37*** | (2006.01) |
| *C11D 1/29* | (2006.01) |
| *C11D 1/72* | (2006.01) |

(52) U.S. Cl.

CPC .. *C11D 1/37* (2013.01); *C11D 1/83* (2013.01); *C11D 11/0082* (2013.01); *C11D 17/06* (2013.01); *C11D 1/22* (2013.01); *C11D 1/29* (2013.01); *C11D 1/72* (2013.01)

(58) Field of Classification Search

CPC .... C11D 11/00; C11D 11/0082; C11D 17/06; C11D 1/22; C11D 1/83

USPC ..... 510/451, 457, 495, 394, 101; 264/141, 264/142

See application file for complete search history.

(56) References Cited

U.S. PATENT DOCUMENTS

| | | | | |
|---|---|---|---|---|
| 4,206,069 | A * | 6/1980 | Borrello | 510/445 |
| 4,534,879 | A | 8/1985 | Iding | |
| 4,894,117 | A | 1/1990 | Bianchi et al. | |
| 4,925,585 | A | 5/1990 | Strauss et al. | |
| 4,973,422 | A * | 11/1990 | Schmidt | 510/337 |
| 4,992,193 | A * | 2/1991 | Evans | 510/349 |
| 5,152,932 | A | 10/1992 | Mueller | |
| 5,178,798 | A | 1/1993 | Jolicoeur | |
| 5,318,733 | A * | 6/1994 | Carduck et al. | 264/15 |
| 5,382,377 | A * | 1/1995 | Raehse et al. | 510/445 |
| 5,451,354 | A | 9/1995 | Aouad et al. | |
| 5,494,599 | A | 2/1996 | Goovaerts et al. | |
| 5,646,107 | A | 7/1997 | Emery et al. | |
| 5,665,692 | A | 9/1997 | Kaminsky | |
| 5,856,294 | A | 1/1999 | Emery | |
| 5,955,418 | A | 9/1999 | Kazuta et al. | |
| 6,015,784 | A * | 1/2000 | Kazuta et al. | 510/446 |
| 6,051,544 | A * | 4/2000 | Lang et al. | 510/446 |
| 6,387,869 | B2 | 5/2002 | Bauer et al. | |
| 6,893,589 | B1 | 5/2005 | Misselbrook | |
| 7,022,660 | B1 | 4/2006 | Mort et al. | |
| 7,208,461 | B2 | 4/2007 | Casey et al. | |

(Continued)

FOREIGN PATENT DOCUMENTS

| | | |
|---|---|---|
| DE | 19622443 A1 | 12/1997 |
| DE | 19752711 | 6/1999 |
| DE | 19752711 A1 | 6/1999 |

(Continued)

OTHER PUBLICATIONS

PCT International Search Report in a PCT application PCT/EP2010/055256, dated Oct. 18, 2010 and Written Opinion.

*Primary Examiner* — Lorna M Douyon

(74) *Attorney, Agent, or Firm* — Greenberg Traurig, LLP

(57) ABSTRACT

A process for manufacturing detergent particles comprising the steps of: a) forming a liquid surfactant blend comprising a major amount of surfactant and a minor amount of water, the surfactant part consisting of at least 51 wt % linear alkylbenzene sulfonate and at least one co-surfactant, the surfactant blend consisting of at most 20 wt % nonionic surfactant; b) drying the liquid surfactant blend of step (a) in an evaporator or drier to a moisture content of at most 2 wt % and cooling the output from the evaporator or dryer; c) feeding the cooled material, which output comprises at least 93 wt % surfactant blend with a major part of LAS, to an extruder, optionally along with less than 10 wt % of other materials such as perfume, fluorescer, and extruding the surfactant blend to form an extrudate while periodically cutting the extrudate to form hard detergent particles with a diameter across the extruder of greater than 2 mm and a thickness along the axis of the extruder of greater than 0.2 mm, provided that the diameter is greater than the thickness; d) optionally, coating the extruded hard detergent particles with up to 30 wt % coating material selected from powdered inorganic material and mixtures of such material and nonionic material with a melting point in the range 40 to 90° C.

12 Claims, No Drawings

(56) References Cited

U.S. PATENT DOCUMENTS

| | | | |
|---|---|---|---|
| 2005/0187130 | A1 | 8/2005 | Brooker et al. |
| 2007/0111920 | A1 | 5/2007 | Baur et al. |

FOREIGN PATENT DOCUMENTS

| | | | |
|---|---|---|---|
| EH | WO2005017086 | A1 | 2/2005 |
| EP | 0578871 | A1 | 1/1994 |
| EP | 0814153 | A2 | 12/1997 |
| GB | 823653 | | 11/1959 |
| GB | 1303479 | | 1/1973 |
| JP | 9100499 | A | 4/1997 |
| WO | WO9302176 | A1 | 2/1993 |
| WO | WO9610070 | A1 | 4/1996 |
| WO | WO9638530 | A1 | 12/1996 |
| WO | WO9728245 | A1 | 8/1997 |
| WO | WO9932599 | | 7/1999 |
| WO | WO2006002755 | A1 | 1/2006 |

* cited by examiner

MANUFACTURE OF HIGH ACTIVE DETERGENT PARTICLES

This invention relates to a process to make high active detergent particles from surfactant blends comprising a major amount of linear alkylbenzene sulphonate surfactant.

BACKGROUND AND PRIOR ART

To reduce the chemicals used in the laundry washing process it has been proposed to decrease the builder salts in laundry detergent formulations. Without other formulation changes, this reduction could adversely affect the performance of the composition in hard water. It has been proposed to ameliorate this problem by using surfactant blends that are tolerant of the presence of hardness ions in the wash water, in particular blends tolerant to calcium ions. These surfactant blends have been termed "calcium tolerant surfactant blends".

For the detergent formulator use of such calcium tolerant surfactant blends poses a new problem. Builder materials have often been included in the formulation not only to provide hard water detergency performance, but also to enable efficient manufacture of free flowing granular detergent formulations. Thus, reduction of builders in a formulation, whilst leaving it in the form of free flowing particles, is not straightforward.

Extrusion of detergent compositions is known.

WO 9932599A1 describes a method of manufacturing surfactant particles comprising an anionic surfactant, wherein the method may comprise drying an anionic surfactant and subsequently extruding through apertures, at an elevated temperature, the dried anionic surfactant, optionally blended with, builder, water, polymer and/or nonionic surfactant, and forming the extruded strands into particles, e.g. by cutting and spheronising. The apertures may comprise plain cylindrical apertures of diameter not exceeding 2 mm.

In WO 9932599A1 the material fed to the extruder is preferably an anionic surfactant paste, whose activity (i.e. anionic surfactant content) is most preferably at least 90% wt. The preferred materials of high activity may be prepared by subjecting the as-prepared surfactants to a drying step prior to the extrusion step. Examples of equipment which can achieve this include a rotary drum dryer, or a Chemithon Turbo Tube® drier, or, most preferably, a wiped film evaporator. Preferably, the dried product is a waxy or pasty solid at ambient temperature.

In one preferred method, a feed material comprises an anionic surfactant which contains 2-10% wt of water, and whose activity is 90-98% wt. It is found that the presence of this water aids the processing of the surfactant, within the extruder and/or during a downstream spheronisation step, if carried out. Alternatively, a dried surfactant may be employed in the feed material, and there may be a separate addition of water to aid processing.

WO 9932599A1 states that in some detergent formulations it is desired to have extremely low quantities of water present, or none at all. In such formulations, a non-ionic surfactant may aid the processing of the anionic surfactant within the extruder, and/or their downstream handling. Thus, in one preferred method an anionic surfactant and a non-ionic surfactant are present. The weight ratio of non-ionic surfactant to the anionic surfactant is suitably up to 1 part, preferably up to 0.5 parts, of non-ionic surfactant per part of anionic surfactant (with reference to their active contents). A non-ionic surfactant, when present, may suitably be added at any stage prior to the stage of mechanical working in the extruder; thus it may be added to the material comprising the anionic surfactant prior to the prior drying step (if carried out); prior to the feeding of the material comprising the anionic surfactant into the extruder; at the same time as the feeding of the material comprising the anionic surfactant into the extruder; or subsequent to the feeding of the material comprising the anionic surfactant into the extruder, through a separate feed point, during or, more preferably, prior to the mechanical working thereof.

One preferred class of anionic surfactants disclosed in WO 9932599A1 comprise the alkali metal (preferably sodium) alkyl sulphates (PAS). Another comprises alkali metal (preferably sodium) alkylaryl sulphonates (especially alkylbenzene sulphonates (LAS)).

It is preferred that the particles contain a builder. A builder in particulate form is suitably added to the material comprising the anionic surfactant during or, preferably, prior to the mechanical working thereof. Preferably, the builder, when present, is added to the material comprising the anionic surfactant within the extruder. A builder, when present, may suitably be present in an amount of from 0.1-10 parts per part of the anionic surfactant (active content), by weight. When the anionic surfactant is, or is predominantly, an alkali metal alkylaryl sulphonate, the builder may suitably be present in an amount of from 0.1-5 parts per part of the anionic surfactant (active content), by weight, preferably 0.1-1, most preferably 0.15-0.5 parts, by weight. The main ingredients of the extruded particles are preferably anionic surfactant and builder.

According to WO 9932599A1 following the extrusion process, it may be necessary to change the appearance and handling characteristics of the extrudate strands. This may be conveniently achieved by means of "chopping" the extrudate to the required length. A spheronising procedure may be carried out, if wished, on the chopped extrudate.

In all examples of WO 9932599A1 the particles were chopped into pieces in standard manner and then spheronised to give roughly spherical particles of approximately 1 mm diameter. Examples 1, 3, 4, 5 and 6 used alkyl sulphate anionic surfactant paste (PAS). As will be clear from examples 1 and 6, PAS is an unusual surfactant. It can be extruded without much drying or without any inorganic builder structurant present. This is due to the known fact that it has a hardness of about 2 MPa, which is relatively independent of the amount of water in the paste at below 10% moisture. Thus, it could be broken up in example 1 and it could be extruded satisfactorily, without need for any inorganic structuring in example 6. This contrasts markedly with the LAS surfactant used in example 2 of WO 9932599A1. The skilled person is well aware that LAS-rich pastes are sticky. Thus, it is conventional to add large amounts of solid structuring and liquid carrying materials, especially if further liquid-like material such as non ionic surfactant is also being added. Note that example 2 does not use any nonionic surfactant.

Example 2 declares a water content of 2-4% (based on "100-active" as on page 5 lines 25-27 of the application). At such high water levels LAS is too soft and sticky to extrude and cut. Thus, high levels of solid matter are normally added, like the 42% builder solids added to the extruder in Example 2. If nonionic had also been added, as in other examples of WO 9932599A1, using PAS, even higher levels of the solid builder addition would have been needed. The nonionic surfactant added to the extruder would not be molecularly blended with the LAS and would tend to be squeezed to the outside of the extruded strands, making them even stickier in the absence of solid builder carrier material to "soak them up".

WO 9932599A1 envisages that nonionic surfactant could be added into the anionic surfactant before it enters the extruder, rather than in the extruder. But it does not perform this variant and the additional benefits of doing it for LAS rich, rather than PAS rich, compositions are not disclosed. The surfactants are not disclosed to be dried to a moisture content of less than 2%.

GB1303479 describes the formation of a water-soluble cleaning composition by extrusion of particles of length 0.5-10 mm. and cross-sectional area 0.04-0.8 $mm^2$ each comprising (a) a higher ($C_{9-18}$) alkyl aryl sulphonate, (b) a lower ($C_{1-3}$) alkyl benzene sulphonate, (c) an inorganic salt and (d) water. In one embodiment (Example 1), the dry ingredients are ground together in a mill, mixed with wet ingredients in a ribbon amalgamator and milled into ribbons, which are carried by conveyer belt to a plodder. The plodder is equipped with a wire mesh of 0.5 mm. openings and a perforated plate having holes, which taper from 12 to 16 mm, with the larger diameter at the exit. The material is extruded through the plate, cooled by an air jet and then carried on a conveyer belt through a further air flow to a granulator fitted with an 8-mesh screen, which breaks the extruded strands into the required lengths. This document proposes the addition of sodium aryl sulphonate as a hydrotrope, to get fast dissolution. Thus, in the examples, there are comparatively low levels of surfactants in order to make space for the high levels of hydrotrope and builders. The drying process appears to happen post-extrusion. The particles have small cross-sectional area and are relatively long at 3 to 4 mm.

Surfactant blends comprising linear alkylbenzene sulphonate (LAS) and at least one co-surfactant have been shown to provide excellent detergency, even in the presence of hardness ions. However, these blends tend to be soft and lead to sticky compositions that cake upon storage.

This is recognised in U.S. Pat. No. 5,152,932(A), which discloses neutralisation of PAS/LAS blends using concentrated caustic in a loop reactor. The neutralized product preferably has less than or equal to about 12% by weight of water.

It is most preferred that essentially no detergency builders or additional organic materials are fed into the continuous neutralization system. Mixtures of PAS and LAS are preferred because of improved dispersibility of detergent particles formed from a paste made with the mixture. The final ratio of PAS to LAS should be between 75:25 and 96:4, preferably between 80:20 and 95:5. Thus the compositions disclosed should have less than 51% LAS. The keeping of LAS to a lesser amount is preferred because the neutralized material is then not unacceptably sticky, yet the particles formed from the cooled paste are dispersible in 15.5° C. water. Paste made from alkyl benzene sulfonic acid alone is said to be soft, sticky, and therefore difficult to form into non-sticky, discrete surfactant particles.

When 73% active caustic is used, the molten paste ordinarily has between about 9 and 11% by weight of water. This water level is too high to render LAS rich compositions non sticky.

The process further contemplates the blending of PEG or nonionic with the anionic pastes. There are no examples using nonionic.

This document says that detergent particles can be formed in various ways from the neutralized product exiting the continuous neutralization system. The molten paste can be atomized into droplets in a prilling (cooling) tower. To avoid prilling at all, the molten paste can be simultaneously cooled and extruded, and cut or ground into desirable particle sizes. A third choice is to allow the molten paste to cool on a chill roll, or any heat exchange unit until it reaches a doughy consistency, at which point other detergent ingredients can be kneaded in. The resulting dough can then be granulated by mechanical means.

A fourth and preferred choice is to cool the molten paste into flakes on a chill roll, then grind the flakes to the desired particle size. If additional drying is required, the cooled flakes can be dried in a rotary drum with hot air or in a fluid bed prior to grinding.

There are no examples using extrusion. This disclosure teaches against the use of LAS rich systems. Example IV used LAS. Even with addition of PEG, the 9 wt % water cooled product is said to be solid in nature but much stickier than the PAS examples. Similarly the PAS rich example V (with some LAS) is said to have improved dispersibility compared to PAS alone as active, but that as the level of LAS is increased, the softness and stickiness of the particle increases. At high LAS levels, it is said that the particles are less suitable for use as detergent particles because of their stickiness. According to the data in this application, the best compromise between low stickiness and good dispersibility is an alkyl sulfate/alkyl benzene sulfonate ratio of about 88/12 i.e. a significant excess of PAS over LAS and a LAS content of well below 51%.

One solution to this stickiness/caking problem for high LAS blends that does not involve using builder in the mix is to enclose the detergent in a rigid capsule as proposed in WO2006/002755. This solution is excellent for use in washing machines but it has drawbacks when the dose needs to be fine tuned for the amount of laundry or water used, as is often the case for hand washing of laundry.

Yet a further solution is to coat the sticky granules. Such a stickiness reducing coating is described in U.S. Pat. No. 7,022,660(B1), which relates to detergent particles having a coating or partial coating layer of a water-soluble material.

The particle core may comprise a detergent particle, agglomerate, flake etc. The coated particles have a number of improved properties among which is that the coated particles provide improved clumping and flowability profiles to detergent products containing the particles. The particle coating layer provides a coating, which is crisper and non-tacky. While effective at improving flowability in all detergent products, it is particularly effective at preventing clumping in products containing surfactants which are more difficult to dry to a non-tacky state including nonionic surfactants, linear alkyl benzene sulfonates ("LAS"), and ethoxylated alkyl sulfates or in detergent products containing high amounts of surfactant actives (i.e. greater than about 25 wt % surfactant active).

While such a coating modifies the properties of the finished detergent particle, it does not solve the problem of providing a non-sticky and easily cuttable output from the extruder. In a production plant, the material exiting the extruder must be hard enough to cut into repeatable sized particles that does not deform as the cutter passes through it, stick neither to the cutter nor to each other. They must also be hard and non-sticky enough to be used, or to be stored and handled in bulk until they are coated if a coating is to be applied. This might entail them being put into a big bag and even transported to another plant. Thus the solution of applying a coating is not sufficient to solve the problem of stickiness of LAS that is not structured with large, typically 30% or more, amounts of inorganic particles Thus, the present inventors sought a solution to the problem of caking of particulate detergent compositions comprising high active surfactant blends with a major part of LAS, which did not need a special unit dose storage container for the detergent particles of the composition, or use structuring of the particles with a high (>10%) incorporation high inorganic solids loading in the particles.

SUMMARY OF THE INVENTION

According to the present invention there is provided a process for manufacturing detergent particles comprising the steps of:

a) forming a liquid surfactant blend comprising a major amount of surfactant and a minor amount of water, the surfactant part consisting of at least 51 wt % linear alkylbenzene sulfonate and at least one co-surfactant, the surfactant blend consisting of at most 20 wt % nonionic surfactant;

b) drying the liquid surfactant blend of step (a) in an evaporator or drier to a moisture content of less than 1.5 wt % and cooling the output from the evaporator or dryer;

c) feeding the cooled material, which output comprises at least 93 wt % surfactant blend with a major part of LAS, to an extruder, optionally along with less than 10 wt % of other materials such as perfume, fluorescer, and extruding the surfactant blend to form an extrudate while periodically cutting the extrudate to form hard detergent particles with a diameter across the extruder of greater than 2 mm and a thickness along the axis of the extruder of greater than 0.2 mm, provided that the diameter is greater than the thickness;

d) optionally, coating the extruded hard detergent particles with up to 30 wt % coating material, preferably selected from inorganic material and mixtures of such material and nonionic material with a melting point in the range 40 to 90° C.

To facilitate extrusion it may be advantageous for the cooled dried output from the evaporator or drier stage (b) comprising at least 95 wt % preferably 96 wt %, more preferably 97 wt %, most preferably 98 wt % surfactant to be transferred to a mill and milled to particles of less than 1.5 mm, preferably less than 1 mm average diameter before it is fed to the extrusion step (c).

To modify the properties of the milled material a powdered flow aid, such as Aerosil®, Alusil®, or Microsil®, with a particle diameter of from 0.1 to 10 μm may be added to the mill in an amount of 0.5 to 5 wt %, preferably 0.5 to 3 wt % (based on output from the mill) and blended into the particles during milling.

The output from step b, or the intermediate milling step, if used, is fed to the extruder, optionally along with minor amounts (less than 10 wt % total) of other materials such as perfume and/or fluorescer, and the mixture of materials fed to the extruder is extruded to form an extrudate with a diameter of greater than 2 mm, preferably greater than 3 mm, most preferably greater than 4 mm and preferably with a diameter of less than 7 mm, most preferably less than 5 mm, while periodically cutting the extrudate to form hard detergent particles with a maximum thickness of greater than 0.2 mm and less than 3 mm, preferably less than 2 mm, most preferably less than about 1.5 mm and more than about 0.5 mm, even 0.7 mm. Whilst the preferred extrudate is of circular cross section, the invention also encompasses other cross sections such as triangular, rectangular and even complex cross sections, such as one mimicking a flower with rotationally symmetrical "petals". Indeed the invention can be operated on any extrudate that can be forced through a hole in the extruder or extruder plate; the key being that the average thickness of the extrudate should be kept below the level where dissolution will be slow. As discussed above this is a thickness of about 2 mm. Desirably multiple extrusions are made simultaneously and they may all have the same cross section or may have different cross sections. Normally they will all have the same length as they are cut off by the knife. The cutting knife should be as thin as possible to allow high speed extrusion and minimal distortion of the extrudate during cutting. The extrusion should preferably take place at a temperature of less than 45° C., more preferably less than 40° C. to avoid stickiness and facilitate cutting. The extrudates according to the present process are cut so that their major dimension is across the extruder and the minor dimension is along the axis of the extruder. This is the opposite to the normal extrusion of surfactants. Cutting in this way increases the surface area that is a "cut" surface. It also allows the extruded particle to expand considerably along its axis after cutting, whilst maintaining a relatively high surface to volume ratio, which is believed to increase its solubility and also results in an attractive biconvex, or lentil, appearance. Elsewhere we refer to this shape as an oblate spheroid. This is essentially a rotation of an ellipse about its minor axis.

It is surprising that at very low water contents the LAS containing surfactant blends can be extruded to make solid detergent particles that are hard enough to be used without any need to be structured by inorganic materials or other structurants as commonly found in prior art extruded detergent particles. Thus, the amount of surfactant in the detergent particle can be much higher and the amount of builder in the detergent particle can be much lower.

Preferably the blend in step (a) comprises at least about 60 wt %, most preferably at least about 70 wt % surfactant and preferably at most about 40 wt %, most preferably at most 30 wt % water, the surfactant part consisting of at least 51 wt % linear alkyl benzene sulphonate salt (LAS) and at least one co-surfactant;

Preferably, the co-surfactant is chosen from the group consisting of: SLES, and nonionic, together with optional soap and mixtures thereof. The only proviso is that when nonionic is used the upper limit for the amount of nonionic surfactant has been found to be 20 wt % of the total surfactant to avoid the dried material being too soft and cohesive to extrude because it has a hardness value less than 0.5 MPa.

Preferably, the surfactant blend is dried in step (b) to a moisture content of less than 1.2 wt %, more preferably less than 1.1 wt %, and most preferably less than 1 wt %.

Drying may suitably be carried out using a wiped film evaporator or a Chemithon Turbo Tube® drier.

Optionally, and preferably, the extruded hard detergent particles are coated by either:

(i) transferring them to a fluid bed and spraying onto them up to 30 wt % (based on coated detergent particle) of inorganic material in aqueous solution and drying off the water; or (ii) dry coating with up to 30 wt % of a water soluble or insoluble particulate of mean PSD<100 μm followed by spraying with either aqueous or non-aqueous liquid and optionally drying/cooling.

If the coating material is not contributing to the wash performance of the composition then it is desirable to keep the level of coating as low as possible, preferably less than 20 wt %, more preferably less than 15 wt % or even 10 wt % or as low as 5 wt %, especially for larger extruded particles with a surface area to volume ratio of greater than 4 $mm^{-1}$.

Surprisingly we have found that at low coating levels the appearance of the coating is very pleasing. Without wishing to be bound by theory, we believe that this high quality coating appearance is due to the smoothness of the underlying extruded and cut particle. By starting with a smooth surface, we unexpectedly found it easy to obtain a high quality coating finish (as measured by light reflectance and smoothness) using simple coating techniques.

The invention also provides a detergent composition comprising at least 70 wt %, preferably at least 85 wt % of coated particles made using the process according to the invention. However, compositions with up to 100 wt % of the particles are possible when basic additives are incorporated into the extruded particles, or into their coating. The composition may also comprise, for example, an antifoam granule.

When the particle is coated it is preferred if the coating is coloured. Particles of different colours may be used in admixture, or they can be blended with contrasting powder. Of course, particles of the same colour as one another may also be used to form a full composition. As described above the coating quality and appearance is very good due to the excellent surface of the cut extrudates onto which the coating is applied in association with the large particle size and S/V ratios of the preferred particles.

It is particularly preferred that the detergent particles comprise perfume. The perfume may be added into the extruder or premixed with the surfactant blend in the mill, or in a mixer placed after the mill, either as a liquid or as encapsulated perfume particles. In an alternative process, the perfume may be mixed with a nonionic material and blended. Such a blend may alternatively be applied by coating the extruded particles, for example by spraying it mixed with molten nonionic surfactant. Perfume may also be introduced into the composition by means of a separate perfume granule and then the detergent particle does not need to comprise any perfume.

DETAILED DESCRIPTION OF THE INVENTION

The Surfactant Blend

Surfactant blends that do not require builders to be present for effective detergency in hard water are preferred. Such blends are called calcium tolerant surfactant blends if they pass the test set out hereinafter. Thus, it may be advantageous if the blend made in step (b) is calcium tolerant according to the test hereinbefore described. However, the invention may also be of use for washing with soft water, either naturally occurring or made using a water softener. In this case, calcium tolerance is no longer important and blends other than calcium tolerant ones may be used.

Calcium-tolerance of the surfactant blend is tested as follows:

The surfactant blend in question is prepared at a concentration of 0.7 g surfactant solids per litre of water containing sufficient calcium ions to give a French hardness of 40 ($4\times10^{-3}$ Molar $Ca^{2+}$). Other hardness ion free electrolytes such as sodium chloride, sodium sulphate, and sodium hydroxide are added to the solution to adjust the ionic strength to 0.05M and the pH to 10. The adsorption of light of wavelength 540 nm through 4 mm of sample is measured 15 minutes after sample preparation. Ten measurements are made and an average value is calculated. Samples that give an absorption value of less than 0.08 are deemed to be calcium tolerant.

Examples of surfactant blends that satisfy the above test for calcium tolerance include those having a major part of LAS surfactant (which is not of itself calcium tolerant) blended with one or more other surfactants (co-surfactants) that are calcium tolerant to give a blend that is sufficiently calcium tolerant to be usable with little or no builder and to pass the given test. Suitable calcium tolerant co-surfactants include SLES 1-7EO, and alkyl ethoxylate non-ionic surfactants, particularly those with melting points less than 40° C. Calcium tolerant blends are already well known in the literature and it is not necessary to repeat all possible combinations here. In a further refinement of the surfactant system it has been found that calcium tolerant LAS systems formed by the addition of SLES or High chain-length nonionic often require use of a third surfactant to more closely match the cleaning performance of fully built detergent systems. Suitable third surfactants include betaines, amine oxides, and cationics, such as the Praepagen® materials from Clariant.

A LAS SLES surfactant blend has a superior foam profile to a LAS Nonionic surfactant blend and is therefore preferred for hand washing formulations requiring high levels of foam. SLES may be used at levels of up to 30%.

Addition of a nonionic surfactant (5-20%) to LAS changes the behaviour of the surfactant blend in the dryer. This gives a surprising increase in throughput. Nonionic 7EO may be used at levels of between 5 and 20% based on dry surfactant. NI 30EO may be used at levels of up to 20%.

Material Characteristics of the Surfactant Blends

To enable sufficient Calcium tolerance for LAS blends an additional surfactant material such as SLES or Nonionic surfactant is added. The level that needs to be added to achieve calcium tolerance for the LAS rich blend varies according to the exact surfactant system but the effect can easily be tested to arrive at a suitable level for calcium tolerance. The added non-LAS surfactants should also be liquid-like and not exceed 50 wt % of the total surfactant, the balance of surfactant being LAS. Preferred added surfactants are selected from Nonionic 7EO and/or Nonionic 30EO and/or SLES and/or PAS.

The structuring of the surfactant blend is done by the LAS. This eliminates the need for the usual inorganic structurant, such as silicate. However, such an approach is found to require the surfactant blend to be dried to very low moisture contents of at most 2 wt %, preferably at most 1.5 wt %, more preferably at most 1.2 wt % and most preferably at most 1 wt %. At these moisture levels, a high active mixed surfactant detergent particle with dimensional integrity and free flowing behaviour can be extruded. Where calcium tolerance is not critical it is technically possible to use some soap to further structure the extrudates. Up to 30 wt % soap may be added to the evaporator or dryer, but it is preferred to keep the amount of soap lower: below 20 wt %, more preferably below 10 wt %, most advantageously zero when calcium tolerance is needed.

Increasing the nonionic content within the LAS rich surfactant blend reduces the hardness of the dried blend. Hardness is also related to moisture content of the dried blend. The maximum nonionic level that can be included is about 20%, above this the dried blend is too soft to mill before the extruder, or cut after the extruder. The minimum inclusion level of nonionic in a LAS/nonionic binary blend is about 5%.

A preferred detergent composition has a LAS/SLES surfactant blend. However, the replacement of 20% of the LAS with PAS results in a product with improved storage stability and a similar cleaning profile.

Processing

Blending

The surfactants are mixed together before being input to the drier. Conventional mixing equipment is used.

Drying

To achieve the very low moisture content of the surfactant blend, scraped film devices may be used. A preferred form of scraped film device is a wiped film evaporator. One such suitable wiped film evaporator is the "Dryex system" based on a wiped film evaporator available from Ballestra S.p.A. Alternative drying equipment includes tube-type driers, such as a Chemithon Turbo Tube® drier, and soap driers.

Chilling and Milling

The hot material exiting the scraped film drier is subsequently cooled and broken up into suitable sized pieces to feed to the extruder. Simultaneous cooling and breaking into flakes may conveniently be carried out using a chill roll. If the flakes from the chill roll are not suitable for direct feed to the extruder then they can be milled in a milling apparatus and/or they can be blended with other liquid or solid ingredients in a blending and milling apparatus, such as a ribbon mill. Such milled or blended material is desirably of particle size 1 mm or less for feeding to the extruder.

It is particularly advantageous to add a milling aid at this point in the process. Particulate material with a mean particle size of 10 nm to 10 μm is preferred for use as a milling aid. Among such materials, there may be mentioned, by way of example: Aerosil®, Alusil®, and Microsil®.

Extruding and Cutting

The extruder provides further opportunities to blend in ingredients other than surfactants, or even to add further surfactants. However, it is generally preferred that all of the anionic surfactant, or other surfactant supplied in admixture with water; i.e. as paste or as solution, is added into the drier to ensure that the water content can then be reduced and the material fed to and through the extruder is sufficiently dry. Additional materials that can be blended into the extruder are thus mainly those that are used at very low levels in a detergent composition: such as fluorescer, shading dye, enzymes, perfume, silicone antifoams, polymeric additives and preservatives. The limit on such additional materials blended in the extruder has been found to be about 10 wt %, but it is preferred for product quality to be ideal to keep it to a maximum of 5 wt %. Solid additives are generally preferred. Liquids, such as perfume may be added at levels up to 2.5 wt %, preferably up to 1.5 wt %. Solid particulate structuring (liquid absorbing) materials or builders, such as zeolite, carbonate, silicate are preferably not added to the blend being extruded. These materials are not needed due to the self structuring properties of the very dry LAS-based feed material. If any is used the total amount should be less than 5 wt %, preferably less than 4 wt %, most preferably less than 3 wt %. At such levels no significant structuring occurs and the inorganic particulate material is added for a different purpose, for instance as a flow aid to improve the feed of particles to the extruder.

The output from the extruder is shaped by the die plate used. The extruded material has a tendency to swell up in the centre relative to the periphery. We have found that if a cylindrical extrudate is regularly sliced as it exits the extruder the resulting shapes are short cylinders with two convex ends. These particles may be described as oblate spheroids. This shape is pleasing visually and its slightly rounded appearance also contributes to improved flow properties of the extruded particles in bulk.

Coating

An advantageous variant of the process takes the sliced extruded particles and coats them. This allows the particles to be coloured easily. It also further reduces the stickiness to a point where the particles are free flowing. In this coated state, they can be used without any need for separation by base powder or other solid diluents. The extruded and cut particles are hard and relatively non-sticky when fresh, but the surfactant mix makes them hygroscopic so they would tend to become sticky over time and should be stored away from moisture. Coating makes them more suitable for use in detergent compositions that may be exposed to high humidity for long periods.

By coating such large extruded particles the thickness of coating obtainable by use of a coating level of say 5 wt % is much greater than would be achieved on typically sized detergent granules (0.5-2 mm diameter sphere).

The extruded particles can be considered as oblate spheroids with a major radius "a" and minor radius "b". Hence, the surface area(S) to volume (V) ratio can be calculated as:

$$\frac{S}{V} = \frac{3}{2b} + \frac{3b}{4 \in a^2} \ln\left(\frac{1+\in}{1-\in}\right) \text{mm}^{-1}$$

When $\in$ is the eccentricity of the particle.

For optimum dissolution properties, this surface area to volume ratio must be greater than 3 $mm^{-1}$. However, the coating thickness is inversely proportional to this coefficient and hence for the coating the ratio "Surface area of coated particle" divided by "Volume of coated particle" should be less than 15 $mm^{-1}$.

By using the process of the invention, a more effective coating can be obtained at a lower level of coating material. Although any known coating may be used, for instance organic, including polymer, or inorganic coating it is particularly advantageous to use an inorganic coating deposited by crystallisation from an aqueous solution as this appears to give positive dissolution benefits and the coating gives a good colour to the detergent particle, even at low deposition levels. An aqueous spray-on of the coating solution in a fluidised bed has been found to give good results and may also generate a slight rounding of the detergent particles during the fluidisation process.

Suitable inorganic coating solutions include sodium carbonate, possibly in admixture with sodium sulphate, and sodium chloride. Food dyes, shading dyes, fluorescer and other optical modifiers can be added to the coating by dissolving them in the spray-on solution or dispersion. Use of a builder salt such as sodium carbonate is particularly advantageous because it allows the detergent particle to have an even better performance by buffering the system in use at an ideal pH for maximum detergency of the anionic surfactant system. It also increases ionic strength, which is known to improve cleaning in hard water, and it is compatible with other detergent ingredients that may be admixed with the coated extruded detergent particles. If a fluid bed is used to apply the coating solution, the skilled worker will know how to adjust the spray conditions in terms of Stokes number and possibly Akkermans number (FNm) so that the particles are coated and not significantly agglomerated. Suitable teaching to assist in this may be found in EP1187903, EP993505 and Powder technology 65 (1991) 257-272 (Ennis).

Another coating technique that may be used is to first dry-coat the extruded particle surface with a layer of electrolyte with mean diameter less than 100 μm using a simple drum-type mixer and subsequently to use an aqueous spray to harden this layer. Drying and/or cooling may be needed to finish the process. The aqueous spray may be replaced by an organic melt using a high melting point nonionic surfactant or nonionic material. In this case, no drying is necessary but cooling may be needed.

It will be appreciated by those skilled in the art that multiple layered coatings, of the same or different coating materials, could be applied, but a single coating layer is preferred, for simplicity of operation, and to maximise the thickness of the coating. The amount of coating should lay in the range 3 to 50 wt % of the particle, preferably 20 to 40 wt % for the best results in terms of anti-caking properties of the detergent particles.

The Extruded Particulate Detergent Composition

Whether coated or uncoated the particles dissolve easily in water and leave very low or no residues on dissolution, due to the absence of insoluble structurant materials such as zeolite. When they are coated, the particles have an exceptional visual appearance, due to the smoothness of the coating coupled with the smoothness of the underlying particles, which is also believed to be a result of the lack of particulate structuring material in the extruded particles.

The invention will now be further described by way of example only.

In the examples, the following nomenclature is used:

LAS—means neutralised LAS acid (LABSA)
LAB—means the "linear" alkylate
LABSA—means LAS acid.
PAS—means primary alkyl sulphate
SCMC—Sodium carboxymethyl cellulose
SLES (XEO)—means sodium lauryl ether sulphate (X Moles Average Ethoxylation)

Test parameters used in the examples are defined and determined in accordance with the following:

Unconfined Compression Test (UCT)

In this test, freshly produced detergent composition was compressed into a compact and the force required to break the compact was measured. The detergent composition was loaded into a cylinder and the surface levelled. A 50 g plastic disc was placed on top of the detergent composition and a 10 kg weighted plunger was placed slowly on top of the disc and allowed to remain in position for 2 minutes. The weight and plunger were then removed and the cylinder removed carefully from the detergent composition to leave a free-standing cylinder of detergent composition with the 50 g plastic disc on top of it. If the compact were unbroken, a second 50 g plastic disc was placed on top of the first and left for approximately ten seconds. Then if the compact were still unbroken, a 100 g disc was added to the plastic discs and left for ten seconds. Then the weight was increased in 250 g increments at 10 second intervals until the compact collapsed. The total weight needed to effect collapse was noted.

For freshly made detergent composition tested under ambient temperature conditions, the cohesiveness of the detergent composition was classified by the weight (w) as follows, (assuming the standard 10.0 kg compaction load is used).

| | |
|---|---|
| w < 1 kg | Good flowing. |
| 1 kg < w < 2 kg | Moderate flowing. |
| 2 kg < w < 5 kg | Cohesive. |
| 5 kg < w | Very cohesive. |

Dynamic Flow Rate (DFR)

Dynamic Flow Rate (DFR) in ml/sec. was measured using a cylindrical glass tube having an internal diameter of 35 mm and a length of 600 mm. The tube was securely clamped with its longitudinal axis vertical. Its lower end was terminated by means of a smooth cone of polyvinyl chloride having an internal angle of 15 DEG and a lower outlet orifice of diameter 22.5 mm. A beam sensor was positioned 150 mm above the outlet, and a second beam sensor was positioned 250 mm above the first sensor.

To determine the dynamic flow rate of a detergent composition sample, the outlet orifice was temporarily closed, for example, by covering with a piece of card, and detergent composition was poured into the top of the cylinder until the detergent composition level was about 100 mm above the upper sensor. The outlet was then opened and the time t (seconds) taken for the detergent composition level to fall from the upper sensor to the lower sensor was measured electronically. The DFR is the tube volume between the sensors, divided by the time measured.

Bulk Density (BD)

"Bulk density" means the bulk density of the whole detergent composition in the uncompacted (untapped) aerated form. It was measured by taking the increase in weight due to filling a 1 litre container with the detergent composition.

Equilibrium Relative Humidity (ERH)

Water activity (usually given the parameter Aw) is related to equilibrium relative humidity (% ERH) by the equation:

$$ERH=100\times Aw$$

Aw=equilibrium partial pressure of moisture/saturation partial pressure of moisture at that temp.

A value for water activity of 1 (ERH=100) indicates pure water, whereas zero indicates total absence of water.

EXAMPLE 1

Surfactant raw materials were mixed together to give a 67 wt % active paste comprising 56.5 parts LAS, 15.2 parts PAS and 28.3 parts SLES.

Raw Materials used were:

| | |
|---|---|
| LABSA | |
| Caustic | (48% Solution) |
| PAS | |
| SLES (3E0) | Stepan BES70 |

The paste was pre-heated to the feed temperature and fed to the top of a wiped film evaporator to reduce the moisture content and produce a solid intimate surfactant blend, which passed the calcium tolerance test. The conditions used to produce this LAS/PAS/SLES blend are given in Table 1.

TABLE 1

| | | |
|---|---|---|
| | Jacket Vessel Temp. | 80 ° C. |
| Feed | Nominal Throughput | 65 kg/h r |
| | Temperature | 70 ° C. |
| | Density | 1.2 kg/l |
| Product | Moisture (KF*) | 1.0% |
| | Free NaOH | 0.16% |

*analysed by Karl Fischer method

On exit from the base of the wiped film evaporator, the dried surfactant blend dropped onto a chill roll, where it was cooled to less than 30° C.

After leaving the chill roll, the cooled dried surfactant blend particles were milled using a hammer mill, 2% Aerosil® was also added to the hammer mill as a mill aid. The resulting milled material is hygroscopic and so it was stored in sealed containers. Its properties are given in table 2.

TABLE 2

| | Phys Props | | | Particle size | | |
|---|---|---|---|---|---|---|
| ERH | UCT kg | DFR ml/s | BD g/l | D (50) μm | >180 μm (%) | >1400 μm (%) |
| 8.7 | 1.9 | 70/71 | 558 | 342.97 | 33.0 | 3.38 |

The cooled dried milled composition was fed to a twin-screw co-rotating extruder fitted with a shaped orifice plate and cutter blade.

The average particle diameter and thickness of samples of the extruded particles were found to be 4.46 mm and 1.13 mm respectively. The standard deviation was acceptably low.

The particles were then coated using a Strea 1 fluid bed. The coating was added as an aqueous solution and coating completed under conditions given in Table 3. Coating wt % is based on weight of the coated particle.

TABLE 3

| Target coating Level | 5 wt % | 10 wt % | 15 wt % |
|---|---|---|---|
| Mass Solid [kg] | 1.25 | 1.25 | 1.25 |
| Coating Solution | Sodium Carbonate (25%) Dye (0.1%) | Sodium Carbonate (25%) Dye (0.1%) | Sodium Carbonate (25%) Dye (0.1%) |
| Mass Coating Solution [kg] | 0.263 | 0.555 | 0.882 |
| Air Inlet Temperature [° C.] | 80 | 80 | 80 |
| Air Outlet Temperature [° C.] | 42 | 40 | 41 |
| Coating Feed Rate [g/min] | 14 | 15 | 15 |
| Coating Feed temperature [° C.] | 38 | 41 | 40 |

As can be seen from Table 3 the samples have different coating levels. These samples and additional samples made using the same process were then equilibrated at 48 and 65% relative humidity and their hardness measured. The hardness measurements are shown in Table 4.

TABLE 4

| Coating Level (%) | Average Hardness @20° C./48% RH (MPa) | Average Hardness @21° C./65% RH (MPa) |
|---|---|---|
| 5 | 0.07 | 0.03 |
| 10 | 0.19 | 0.06 |
| 15 | 0.40 | 0.22 |
| 25 | 0.85 | 0.59 |

EXAMPLE 2

Surfactant mixtures were selected based on their expected calcium-tolerance under typical wash conditions. For this example, two LAS and nonionic surfactant blends were prepared.

Example 2.1LAS/NI-7EO=76.9/23.1 Ratio

Example 2.2LAS/NI-7EO=83.3/16.7 Ratio

The blends were manufactured as pumpable lamellar liquid crystal feedstocks containing ca. 70% total surfactant and 30% water. These feedstock blends were fed to a wiped film evaporator and dried.

Properties of the dried surfactant blends leaving the wiped film evaporator are given in Table 5.

TABLE 5

| | | Example # | |
|---|---|---|---|
| | | 2.1 | 2.2 |
| Jacket Vessel Temp. ° C. | | 84 | 92 |
| Feed | Nominal Throughput kg/hr | 30 | 45 |
| | Temperature ° C. | 71 | 75 |
| | Density kg/l | 0.94 | 1.01 |
| Product | % Moisture(KF) | 0.9 | 1.3 |
| | Free NaOH % | — | — |

Each of these dried surfactant blends was milled using a hammer mill, 2% Aerosil® was added as a mill aid. The resulting dried material is hygroscopic and so was stored in sealed containers. Properties are given in Table 6.

TABLE 6

| | Physical Props | | | | | | % >1400 |
|---|---|---|---|---|---|---|---|
| | ERH | UCT | DFR | BD | D (50) | % >180 | (sieved) |
| 2.1 | Too cohesive for measurements | | | | 668 | 14.0 | 28.3 |
| 2.2 | 8.7 | 400 | 103 | 515 | 376 | 30.0 | 11.8 |

Dried blend 2.1 was found to be too cohesive to feed to the extruder used in example 1 and falls outside the scope of the invention. Dried blend 2.2 was extruded satisfactorily using the process described in Example 1. It should be noted here that in order to incorporate nonionic even at the levels successfully done in 2.2 it is essential to co-dry the LAS and the nonionic to form a molecular dispersion of the surfactants. Any attempt to blend the surfactants in the extruder leads to extrusion of a sticky mess unless high levels of solids are also used.

The extruded particles formed from dried blend 2.2 were coated as in Example 1 above.

EXAMPLE 3

A mixture of LAB ex Huntsman, nonionic and PEG in the ratio 100:10:2 was sulphonated at pilot plant scale to convert the LAB to LABSA and then neutralised with caustic solution to make the LABSA into LAS.

The only moisture added to the system was contained in the 50% sodium hydroxide solution (low chloride) used as the neutralisation agent. Details of the materials are as specified in table 7. The neutralisation reaction on the LABSA, (Linear Alkyl Benzene Sulphonic acid) was completed in the presence of nonionic and PEG. An 85 w % active paste comprising anionic surfactant, nonionic and PEG that could be pumped with a vane pump was produced. The neutralisation process was continued for 8 hours.

TABLE 7

| Raw Material | Supplier/Trade name | % Active |
|---|---|---|
| PEG 4000 | BP Chemicals | 100 |
| Linear Alkyl Benzene, (LAB) | Huntsman/A225 | 98-100 |
| Nonionic 7EO | Shell Chemicals/Neodol 25-7 | 100 |
| Caustic soda | Univar | 50 |

The paste surfactant mixture was dried in a Turbo-Tube Dryer and milled using a hammer mill: no mill aid was added. The properties of the resulting dried milled composition are given in Table 8.

TABLE 8

| Analysis | Result |
|---|---|
| ERH % | 6.4 |
| Moisture Content % | 0.6 |
| Hardness MPa | 18.6 |
| T90 s | 69 |
| Bulk Density (BD) g/l | 587 |
| Dynamic Flow Rate (DFR) ml/s | 105 |
| UCT | FAIL |
| Particle Size d(10) μm | 173 |
| Particle Size d(50) μm | 570 |
| Particle Size d(90) μm | 941 |

T90=time in seconds for change in the water conductivity to reach 90% of its final magnitude when a 250 mg sample is placed into 500 ml of stirred demineralised water at 25° C.

The dried and milled composition was fed to a twin screw extruder and extruded. The average maximum thickness of the extruded particles was 1.13 mm (sd 0.18) and their average particle diameter was 4.46 mm (sd 0.26).

The particles are coated as in example 1.

EXAMPLE 4

Uncoated extruded particles from example 3 were coated using a coating level of 15 wt %. This was achieved by spraying a 25 wt % sodium carbonate solution, containing 0.5 wt % orange dye, into a fluid bed and evaporating off the excess moisture. The high active extruded particles being coated are hygroscopic and temperature sensitive. Thus, at all times a balance was maintained between the spray rate and evaporation rate of the solution and the temperature of the bed. The fluidised bed is operated as known to the skilled worker in order to avoid agglomeration of the material. The coating conditions used are given in table 9.

TABLE 9

| Analysis | Result |
|---|---|
| Solid Mass | 1.5 kg |
| Air Inlet Temperature | 80° C. |
| Air Outlet temperature | 35° C. |
| Spray Rate | 22 g/min |
| Spray Temperature | 40° C. |

EXAMPLE 5

Conventional detergent base powder containing sodium linear alkyl sulphonate (LAS) as surfactant and sodium tripolyphosphate as builder was dry mixed with uncoated extruded particles made according to the first part of the process of example 1 and using a blend of LAS/PAS/SLES with ratio 58.3/14.6/27. The extruded particles used had a circular cross section with average diameter 5 mm and average maximum thickness 1 mm.

The mixtures of detergent powder and extruded particles were sealed in conventional unlaminated cardboard packs and stored at 28° C. and 70% Relative Humidity for 4 weeks. Packs were examined periodically to determine how much caking had occurred by pouring the product from the pack onto a tray and visually estimating the percentage of lumped powder. Examples 5A, 5B and 5C in Table 10 correspond to extruded particle levels of 0, 20 and 40% by weight based on the combined weight of particles and powder.

The results in Table 10 show that powders containing up to and including 20 wt % uncoated extruded particles according to the invention are storage stable, but above that level and at some point below 40 wt % extruded particles, the mixture with base powder becomes unstable on storage.

TABLE 10

| Example | Weight % of extrudates in pack | Caking ex-pack week 2 | Caking ex-pack week 4 |
|---|---|---|---|
| 5A | 0 | <25% | <50% |
| 5B | 20 | <25% | <50% |
| 5C | 40 | >75% | >75% |

Similar results are obtained with base powders including zeolite and/or carbonate in place of the sodium tripolyphosphate.

EXAMPLE 6

100 parts of the milled material produced in example 1 at the exit of the mill was mixed in a tumbling mixer with 1.15 parts fluorescer and 3 parts SCMC. This mixture was then fed to a twin-screw co-rotating extruder along with 1.15 parts perfume liquid. The resulting mixture was extruded through a shaped orifice plate and cut with a cutter blade to produce detergent particles comprising just under 4 wt % perfume, fluorescer and SCMC in addition to surfactant.

The extruded particles were determined to have an average thickness of 1.11 mm (sd 0.18) range 0.9 to 1.4. The T90 dissolution time was 73 seconds.

Caking on extended storage was acceptable after coating. The material was sealed in conventional unlaminated cardboard packs and stored at 28° C. and 70% relative humidity for 8 weeks. Packs were examined during this period for acceptable powder flow properties/caking by pouring the product from the pack onto a tray and visually estimating the percentage of lumped powder. Results are given in Table 11.

TABLE 11

| Pack Sample | Flow | Residue in Pack | Lumps ex pack |
|---|---|---|---|
| Coated | Satisfactory | 25-50% | 25% |
| Uncoated | No flow | 100% | 100% |

EXAMPLE 7

This example shows that the superior appearance of the extruded particles is due to the uncoated particle being smoother than conventional detergent particles and the final surface being smoother still. This need for the underlying surface to be smooth before a coating is applied is known generally but it was nevertheless surprising just how improved the coated particles appear compared with other conventional detergent particles. The underlying smoothness of the extruded particles is thought to be assisted by their not containing solid structuring materials, unlike prior art extruded particles. The particles are also superior in appearance when compared to prior art granules made by other processes.

In order to determine the value of Ra (average surface roughness) for each particle sample we used a non contact optical profilometer equipment comprising a low powered near-infrared Laser Stylus mounted on a moveable stage controlled by a computer. A Laser stylus is a displacement transducer based on technology found in a compact disc player. In a compact disc player, a focussed laser is used to record the pits embedded within the disk. Since the disk wobbles slightly as it spins, an auto-focus mechanism is needed to maintain the in-focus condition. This auto-focus mechanism uses the light reflected from the disc to generate an error signal that can be used to lock the laser onto the surface. The error signal is minimised through the real-time adjustment of a lens position, and a feedback loop to achieve an acceptable response time.

To use such a device to measure surface topography requires the laser to be focussed on the surface, and then the surface moved in a raster fashion (line scan Y and step scan X)

underneath it. A recording of the lens position gives a measurement of the surface height variation.

The major component of the Laser Profilometer is a laser displacement transducer (Rodenstock Laser Stylus RM 600 LS10) which operates in the near-infrared at 780 nm. This transducer gives a spot size of about 1.3 μm on the measured surface, has a distance resolution of 1 nm and an operational range of ±400 μm. The 'stand-off' distance between the end of the transducer and the measured surface is about 10 mm, in air, and the full included cone angle of the focused beam is approximately 47°. This transducer is an example of an 'optical follower' that utilises auto-focusing optics to 'lock-onto' an interface and to measure its location relative to a reference position internal to the device.

Ra (average surface roughness) is one of the most effective surface roughness measures and is commonly adopted in general engineering practice. It gives a good general description of the height variations in the surface. A mean line is first found that is parallel to the general surface direction and divides the surface in such a way that the sum of the areas formed above the line is equal to the sum of the areas formed below the line. The surface roughness Ra is now given by the sum of the absolute values of all the areas above and below the mean line divided by the sampling length.

The test sample is mounted on the stage to reflect the laser. The sample is held sufficiently firmly to prevent any spurious movement during scanning.

Data is evaluated on a computer where programs flatten the topography, line by line, to leave deviations net of tilt and curvature. Ra is the mean roughness of the measured surface heights of a sample.

Because some of the original sample particles proved to be insufficiently reflective for the profilometer instrument to be able to lock onto the surface, we made surface replicates of all three test particles using a material called Silflo (Ex-Flexico), which is a light-bodies silicone rubber impression material that readily flows into surface features. The material was prepared and then a coated particle was pushed (gently) into the rubber before it hardened. On removing the particle, a surface replicate is left in the Silflo.

We then placed this replicate impression into the laser profilometer and measured a section, up to 1000 μm by 1000 μm, with data taken every μm in both x and y directions. For each type of particle, we measured multiple replicates in this way. Results are given in Table 12. The details of the original particles are given below.

Extruded particles were made according to the first part of the process of example 1 and using a blend of LAS/PAS/SLES with ratio 58.3/14.6/27. The extruded particles had a circular cross section and dimensions of about 5 mm diameter by 1 mm.

A fraction of these extruded particles was coated using a 25% sodium carbonate coating solution to give a final coating level of 30 wt %.

The conventional High active granule was made using the process described in WO2002/24853 and had the composition:

| | |
|---|---|
| LAS | 65.5% |
| Soda Ash | 11.5% |
| Zeolite | 17.9% |
| Sodium Sulphate | 2.2% |
| Water and minors | balance |

To be as good a comparison as possible with the larger extruded particles we used an oversized granule (retained on a 1.18 mm sieve). Even so, due to this being smaller than the extruded particles, we could only measure a 500 μm by 500 μm segment.

TABLE 12

| | Ra (μm) | Ra (μm) | Ra (μm) |
|---|---|---|---|
| High Active Granule | 18.020 | 21.732 | — |
| uncoated extruded particles | 7.611 | 6.439 | 6.371 |
| coated extruded particles | 5.384 | 2.610 | 3.116 |

It can be seen from table 12 that a conventional high active granule detergent particle is much rougher than the uncoated extruded particle and that when coated the extruded particle is smoother still. Ra (μm) of less than 6, even less than 4, was achieved for the coated extruded particles. The combination of larger radius of curvature, smooth base particle and coating gives the coated extruded particle a stunning appearance when compared to the typical appearance of a detergent particle. When coupled with a low particle size distribution this leads to a dramatically visually different and enticing particle that consumers would really appreciate is different from their normal product.

The invention claimed is:

1. A process for manufacturing detergent particles comprising the steps of:

a) forming a liquid surfactant blend comprising:
   1) a first surfactant, being linear alkylbenzene sulfonate (LAS) in an amount of at least 51 wt %,
   2) at least one second surfactant, being at least one nonionic calcium tolerant surfactant in an amount of from 5 wt % to 20 wt %,
   3) at least one third surfactant selected from the group consisting of betaines, amine oxides, cationics, and any combination thereof, and
   4) water;

b) drying the liquid surfactant blend of step (a) to a moisture content of less than 1.5 wt % to form a dried surfactant blend and cooling the dried surfactant blend to a temperature of less than 30° Celsius; and c) feeding a feed to an extruder, wherein the feed comprises the dried surfactant blend at the temperature of less than 30° Celsius and at least one additive material in an amount of up to 10 wt % based on the total weight of the feed, and extruding the feed to form an extrudate while periodically cutting the extrudate to form hard detergent particles with a diameter of greater than 2 mm and a thickness of greater than 0.2 mm, provided that the diameter is greater than the thickness;

d) coating the hard detergent particles with at least one coating material in a sufficient amount to result in the at least one coating material being in a range of 3 wt % to 30 wt % of each hard detergent particle.

2. The process according to claim 1 in which the liquid surfactant blend of step (a) comprises:

at least 60 wt % of the group of the first surfactant, the at least one second surfactant, and the at least one third surfactant; and at most 40 wt % water.

3. The process according to claim 1 in which the dried surfactant blend made in step (b) is calcium tolerant.

4. The process according to claim 1, comprising:

milling the dried surfactant blend to particles of less than 1.5 mm to form the feed for the step (c).

5. The process according to claim 4, comprising:

adding a powdered flow aid with a particle diameter of from 0.1 to 10 μm in an amount of 0.5 to 5 wt % to the dried surfactant blend during the milling.

6. The process according to claim 1 in which the at least one additive material is selected from the group consisting of perfume, fluorescer, shading dye, enzyme, silicone antifoam, polymeric additive, preservatives, and any combination thereof.

7. The process according to claim 1 in which the dried surfactant blend has the moisture content of less than 1 wt %.

8. The process according to claim 1, wherein the drying is performed in one of: an evaporator and a drier.

9. The process according to claim 8, wherein the evaporator is a wiped film evaporator and the drier is a tube drier.

10. The process according to claim 1 in which the hard detergent particles are oblate spheroids.

11. The process according to claim 1 in which the diameter of the hard detergent particles is greater than 4 mm.

12. The process according to claim 1 in which the at least one coating material is selected from one of a powdered inorganic material and at least one mixture of the powdered inorganic material and at least one nonionic material with a melting point in a range from 40° C. to 90° C.

* * * * *